US005476055A

United States Patent [19]

Hackett et al.

[11] Patent Number: 5,476,055

[45] Date of Patent: Dec. 19, 1995

[54] WATERCRAFT WITH UNDERWATER VIEWING PORT

[75] Inventors: Robin M. F. Hackett, Vancouver; William McCausland, Port Coquitlam, both of Canada

[73] Assignee: Advance Aquasport Ltd., Coquitlam, Canada

[21] Appl. No.: 395,813

[22] Filed: Feb. 28, 1995

[51] Int. Cl.[6] ..... B63B 35/00

[52] U.S. Cl. ..... 114/66; 441/135

[58] Field of Search ..... 441/79, 135; 114/66; 359/665, 895

[56] References Cited

U.S. PATENT DOCUMENTS

| | | | |
|---|---|---|---|
| 2,712,139 | 7/1955 | Kelly | 441/135 |
| 2,926,365 | 3/1960 | Wilcoxon | 441/135 |
| 3,042,945 | 7/1962 | Saeman | 441/135 |
| 3,081,726 | 3/1963 | Betts et al. | 441/135 |
| 4,691,658 | 9/1987 | New et al. | 441/135 |
| 4,840,592 | 6/1989 | Anderson | 441/135 |
| 4,844,595 | 7/1989 | Nealy | 359/895 |
| 4,925,417 | 5/1990 | Warren | 441/65 |
| 5,127,862 | 7/1992 | Pia | 441/79 |

*Primary Examiner*—Jesus D. Sotelo
*Attorney, Agent, or Firm*—Bull, Housser & Tupper

[57] ABSTRACT

Watercraft has a hull with a viewing opening therein extending between upper and lower portions of the hull. A transparent viewing unit is fitted within the viewing opening and has a periphery spaced apart from side wall of the viewing opening to define a draining space between the side wall and the viewing unit. This provides a peripheral clearance extending generally around the unit for draining water through the hull irrespective of angle of the watercraft with respect to the horizontal. A cowl extends peripherally around the viewing opening and has a lower portion sealing the viewing opening to prevent passage of water, and an upper portion to embrace portions of a person's face to exclude extraneous light.

21 Claims, 5 Drawing Sheets

WATERCRAFT WITH UNDERWATER VIEWING PORT

BACKGROUND OF THE INVENTION

The invention relates to watercraft with an underwater viewing port or window, particularly a surfboard-type of craft in which a person lies prone on an upper surface of the craft.

It is known to provide surfboard-type crafts with viewing ports for a person lying on craft to view underwater life through the port. One such device is shown in U.S. Pat. No. 4,691,658 (New et al) which discloses a paddle board having a passageway extending between upper and lower surfaces of the deck, with the passageway covered by spaced apart transparent panels or "lenses". The upper lens is inclined to the horizontal and is partially surrounded by a hood or cowl which attempts to shade the upper lens from extraneous or background light. Any water collecting on the inclined upper lens drains through an opening disposed adjacent a lower portion of the lens, and then onto the upper surface of the craft. U.S. Pat. No. 3,081,726 (Betts et al) also discloses a floating underwater viewing unit which has a cylindrical or annular rim provided with padding to receive a person's face. The rim surrounds a transparent panel which is generally adjacent a lower surface of the craft, and has a plurality of vent openings therein to permit exchange of air for the person. Any water or other material passing the rim will collect on the viewing surface and obscure the view therethrough. U.S. Pat. No. 2,926,365 (Wilcoxson) discloses an underwater viewing apparatus having a viewing unit with vertically spaced apart upper and lower horizontal transparent panels. An opening is provided in the lower transparent panel to permit water to enter the viewing unit with a one-way valve to permit air to escape when water enters.

To the inventor's knowledge, there are no floating underwater viewing devices which permit water to drain from an upper portion of the viewing port to a lower portion thereof irrespective of angle of the craft to the horizontal so as to be self-draining, and to simultaneously remove sand or other material that might collect adjacent the viewing port.

SUMMARY OF THE INVENTION

The invention reduces the difficulties and disadvantages of the prior art by providing a watercraft with a viewing port which permits self-draining of water from an upper portion thereof through the hull to a lower portion to facilitate removal of water and other debris that may collect and obscure viewing. In addition, the invention provides a relatively low-cost watercraft in which the viewing port can be easily removed and replaced if needed. The invention also provides a hood or cowl which completely surrounds the viewing port and can receive a wide variety of person's heads, and yet exclude essentially all extraneous or background light from the viewing unit to enhance view quality, and simultaneously provide comfort to rest the head.

A watercraft according to the invention comprises a hull having generally spaced apart upper and lower hull portions and a peripheral edge portion extending peripherally around and between the upper and lower hull portions. The hull has a viewing opening defined by an opening side wall extending through the hull through the upper and lower hull portions. The watercraft further comprises a viewing unit fitted within the viewing opening and having a periphery. Most of the periphery is spaced from the opening side wall to define a draining space between the opening side wall and the viewing unit to provide a peripheral clearance extending around the unit for draining water through the hull irrespective of angle of the watercraft with respect to the horizontal.

The watercraft further comprises a cowl extending peripherally around the viewing opening, the cowl having a lower portion cooperating with the periphery of the unit and an upper portion to embrace portions of a person's face so as to prevent passage of water into the viewing opening and to essentially exclude extraneous light from shining onto an upper surface of the viewing unit. The cowl comprises a forward wall and a rear wall, the walls extending upwardly from adjacent forward and rear edges respectively of the viewing opening. The rear wall has an upper portion with a nose clearance portion to embrace a bridge portion of the nose of the person remote from the nostrils thereof to prevent discharge of air from the nose or mouth onto the viewing unit. The forward wall has an upper portion to contact a forehead of the person and is spaced generally above the upper edge of the rear wall.

The viewing unit has vertically spaced apart upper and lower transparent panels, and at least one wall panel extending between the upper and lower transparent panels to define a closed interior between the panels. The opening side wall of the hull is spaced from the wall panel of the viewing unit by the draining space to permit drainage between the upper and lower hull portions.

Preferably, the viewing unit has an upper surface in a first plane, and the viewing opening in the hull is defined by a rim, the rim having a lower surface in a second plane. At least one spacer extends between the upper surface of the viewing unit and the lower surface of the rim to space the upper and lower surfaces apart to provide a plurality of clearance openings between the planes and extending around the unit. The clearance opening between the planes are smaller than the draining space between the side panel of the viewing unit and the opening side wall of the opening so that relatively coarse material is restricted from passing the clearance openings and thus does not become trapped between the hull side wall and the side wall of the viewing unit. Portions of the periphery of the viewing unit contact spaced apart portions of the opening side wall to restrict relative movement therebetween.

A detailed disclosure following, related to drawings, describes a preferred embodiment of the invention which is capable of expression in structure other than that particularly described and illustrated.

DETAILED DESCRIPTION

FIGS. 1 through 4

Figure 1:
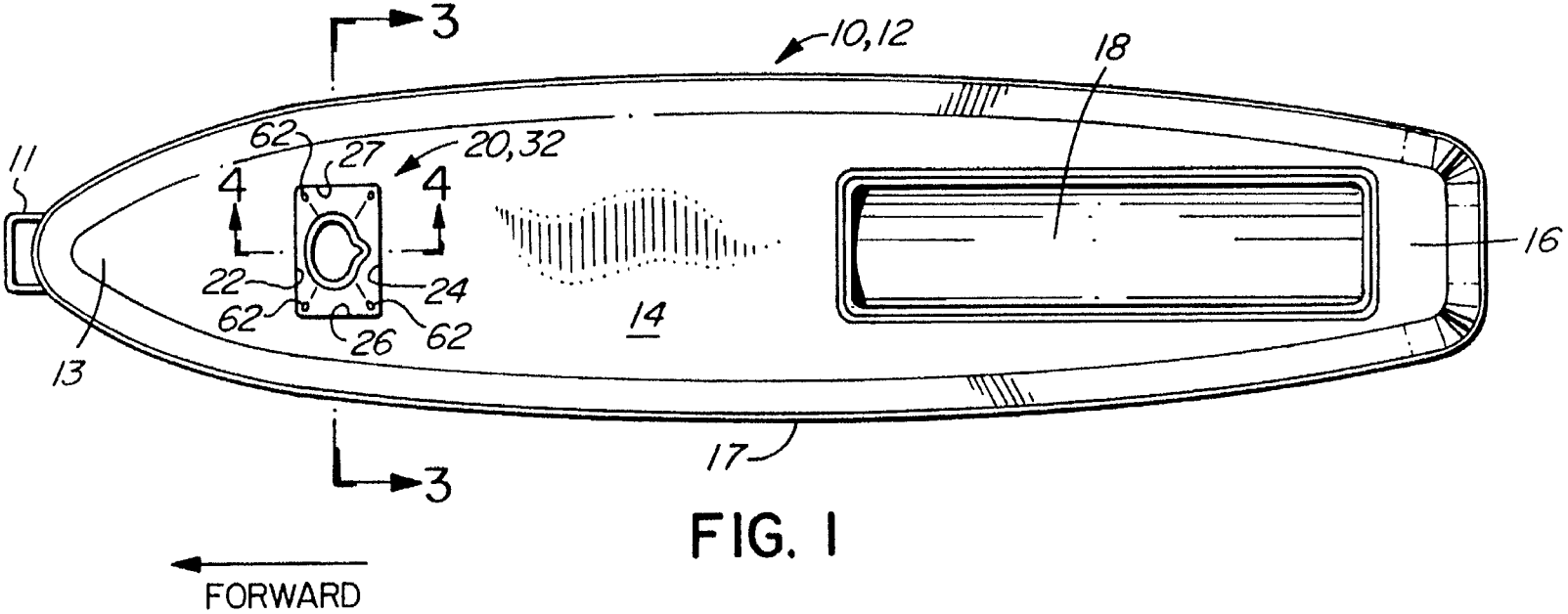
FIG. 1 is a simplified top plan of a watercraft according to the invention shown fitted with a viewing unit.
Figure 2:
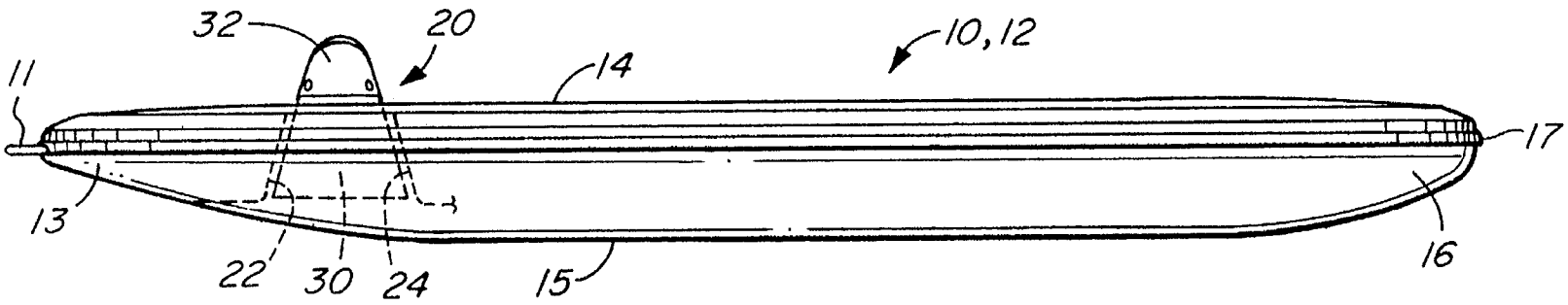
FIG. 2 is a simplified side elevation of the watercraft showing some hidden detail.

Referring mainly to FIGS. 1 and 2, a watercraft 10 according to the invention has a hull 12 having spaced apart upper and lower hull portions 14 and 15 respectively. A peripheral edge portion or gunwale 17 extends peripherally around and between the upper and lower hull portions so as to define a watercraft which resembles a surfboard, but for stability and comfort, is preferably somewhat longer, wider and deeper than a conventional surfboard to provide additional floatation. The watercraft has a bow 13 and a stern 16 which are generally conventionally shaped, and the upper portion has a partially cylindrical recess 18 to carry equipment, for example a scuba tank, food supplies, etc.

Figure 3:
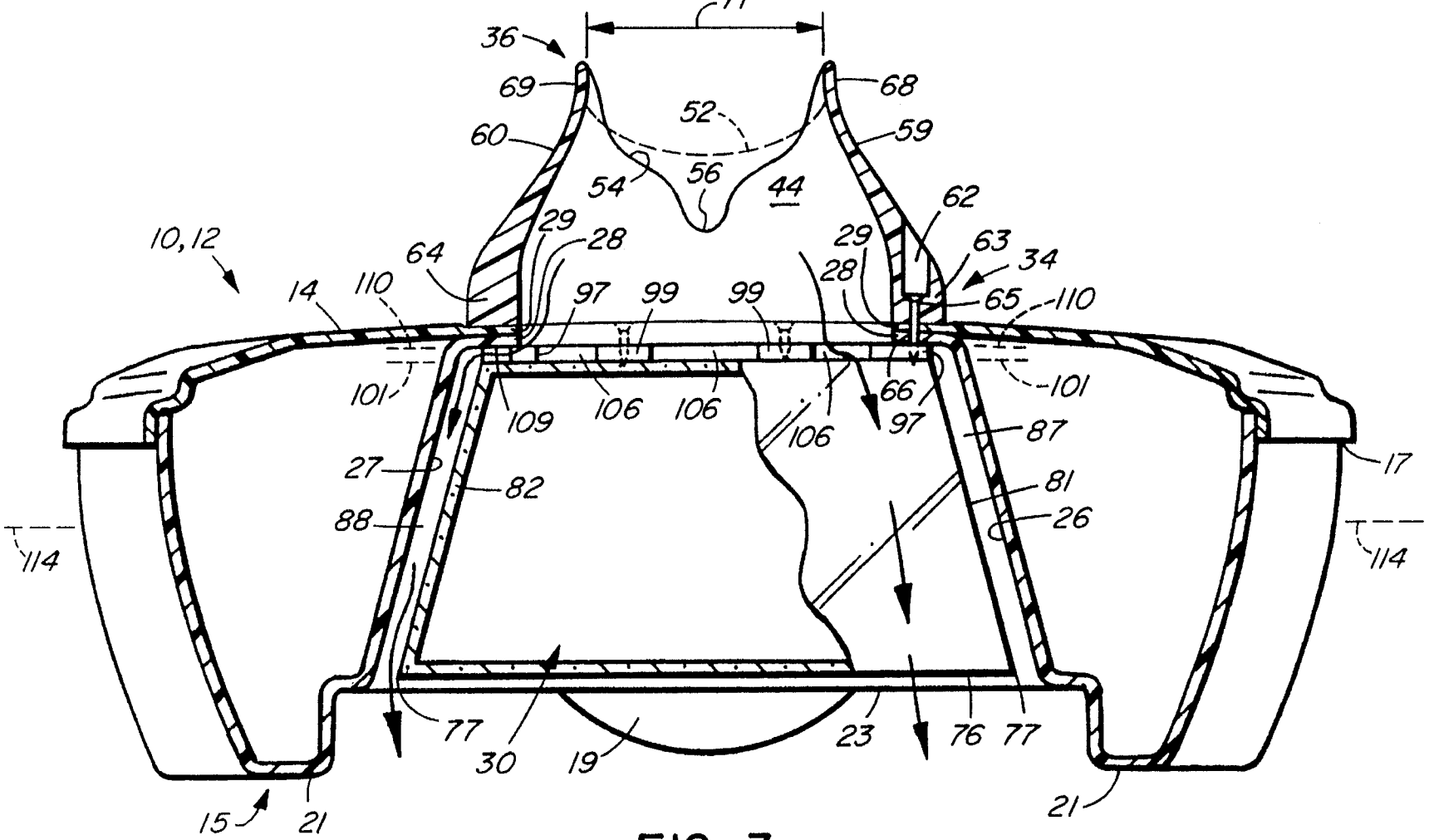
FIG. 3 is a simplified fragmented cross-section on Lines 3—3 of FIG. 1, showing position of a person's head in broken outline, and position of a portion of an optional gear storage compartment.

Referring to FIG. 3, the lower hull portion 15 has a downwardly extending projection 19 to provide clearance for the recess 18 above. The lower hull portion 15 further comprises a pair of laterally spaced apart, longitudinally extending sponsons 21 extending downwardly from outer portions of the hull, so as to provide additional buoyancy spaced laterally outwardly from the hull to increase roll stability, and to facilitate straight line travel, as is well known. A generally flat central surface 23 of the hull extends between the sponsons for an intermediate section of the hull forward of the projection 19. The hull can be formed from two half "shells" of molded plastic having interfitting edges secured together adjacent the gunwale 17. For added security, following common practice, the hull interior can contain closed-cell foamed plastic floatation to reduce the chance of sinking of the watercraft. In addition, a handle 11 can be fitted adjacent the bow 13 as shown to facilitate handling of the watercraft, and for securing it for safety, transportation, storage, etc. If desired, other handles can be fitted at convenient locations on the hull.

Figure 4:
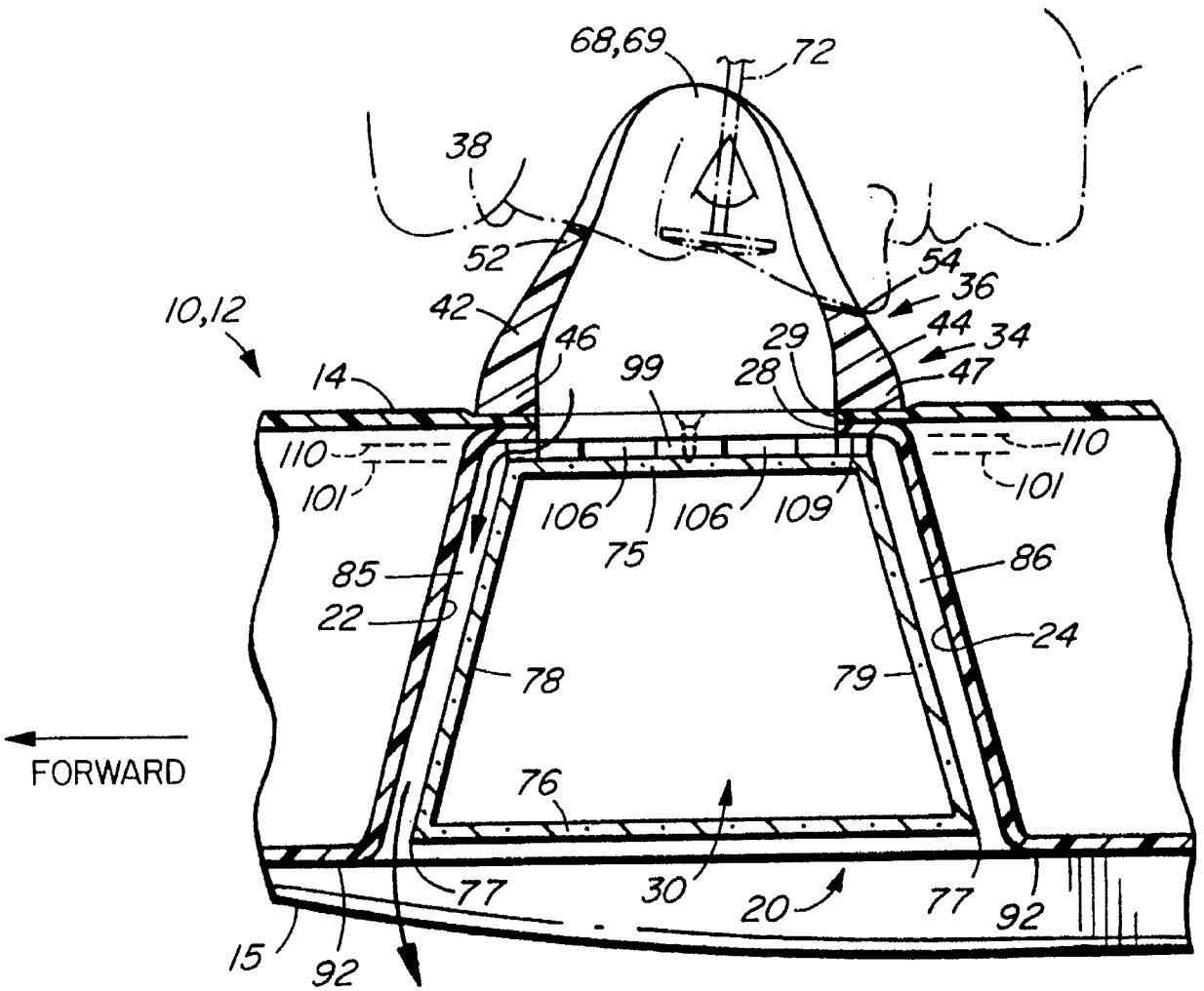
FIG. 4 is a simplified fragmented section on Line 4—4 of FIG. 1, showing a person's head cooperating with the viewing unit.

The watercraft has a viewing opening 20 defined by opening forward and rear walls 22 and 24, and opening side walls 26 and 27. Thus, when viewed vertically, the viewing opening is defined by a generally rectangular cross-sectioned opening side wall extending through the hull between the upper hull portion 14 and the central surface 23 of the lower hull portion 15. As best seen in FIGS. 3 and 4, the opening side wall is made by molding portions adjacent the surface 23 of the lower hull portion 15 to extend upwardly in an upwardly and inwardly inclined, generally rectangular recess, to cooperate with edges of an opening provided in the upper hull portion 14. For simplicity of manufacturing, upper edges of the opening walls 22, 24, 26 and 27 are formed to provide a lower rim 28 to define a generally rectangular opening in the lower hull portion 15. The upper hull portion 14 has a similar generally rectangular opening defined by an upper rim 29, which is closely adjacent the lower rim 28 and generally equal in size thereto so that edges of the rims are generally flush with each other to provide a smooth edged opening passing between the upper and lower hull portions. Thus, an upper portion of the viewing opening 20 has a generally horizontal rim defined by the coincident rims 28 and 29 of the lower and upper hull portions 14 and 15 respectively. The rim therefore has twice the thickness of the remainder of the hull portions and is correspondingly stiffer to provide a deflection resistant rim for reasons to be described.

The watercraft also comprises a viewing unit 30 fitted within the viewing opening 20 to permit the person, not shown, when lying prone on the craft, to peer through the unit to view underwater life. The watercraft further comprises a cowl 32 or face "mask" extending peripherally around the viewing opening to receive a person's face 38 which rests upon the cowl, as shown partially in broken outline in FIG. 4. The cowl extends peripherally around the viewing opening and has a lower portion 34 cooperating with the periphery or rim of the opening as will be described to provide a substantially waterproof seal therewith to prevent water outside the mask from passing into the viewing opening. The cowl has an upper portion 36 shaped to embrace portions of the person's face 38 so as to essentially exclude extraneous light from shining on an upper surface of the viewing unit. The cowl is made from a molded elastomeric material which has sufficient thickness and inherent stiffness to maintain its shape without excessive distortion when the person's face rests lightly on the forward and rear walls as seen in FIG. 4. Preferably, the material is a polyurethane resin composition having Shore Durometer characteristics between about 20 and 60 on the A Scale.

FIGS. 3 and 4

As best seen in FIG. 4, the cowl has forward and rear walls 42 and 44 which extend upwardly from adjacent the forward and rear walls 22 and 24 respectively of the viewing opening. The walls 42 and 44 have lower portions 46 and 47 adjacent the coincident rims 28 and 29 and are relatively thick to provide a substantially stiff base for the lower portion 34. The walls 42 and 44 have upper portions 52 and 54 which are somewhat thinner in cross-section than the corresponding lower portions 46 and 47, the walls tapering smoothly upwardly to provide relatively broad top edges which are only slightly less stiff than the lower portions 46 and 47, and are shaped to engage the forehead and portions of the face adjacent nose respectively.

Referring to FIG. 3, the upper portion 54 of the rear wall 44 has a nose clearance portion 56 which is a "cut-out" to embrace a bridge portion of the person's nose in a position generally remote from the nostrils thereof, to prevent discharge of air from the nose or mouth onto the viewing unit. This is important, as not only does it facilitates breathing, it reduces chances of condensation forming on the viewing unit. For convenience of illustration and comparison, relative location of the upper portion 52 of the forward wall 42 is shown in broken outline in FIG. 3, and it can be seen that the upper portion 52 is spaced generally above the upper portion 54 of the rear wall 44.

As seen in FIG. 3, the cowl has left and right side walls 59 and 60 which are mirror images of each other about a longitudinal axis and have respective lower portions 63 and 64 which have a similar thickness to the lower portions 46 and 47 of the forward and rear walls of FIG. 4. Thus, the lower portion 34 of the cowl 32 has a thickened rim of generally equal thickness on all sides to provide sufficient thickness to resist distortion and to enhance sealing. The lower portion 34 of the cowl is sufficiently thick for securing to the hull 12, and has a plurality of fastener openings 66 (see FIG. 1) extending peripherally therearound to receive fasteners, one such opening being shown in FIG. 3. The opening is recessed to receive a screw or other fastener 65 therein so that a shorter fastener can be used and recessed within the lower portion. The fasteners 65 cooperate with at least some of a plurality of aligned fastener openings 66 in the rim, and additional openings in the viewing unit as will be described with reference to FIGS. 6 and 7. The fastener openings 66 in the rim of the viewing opening extend peripherally around the viewing opening and are sealed against leakage into the hull 12.

The side walls 59 and 60 extend upwardly from positions adjacent the side walls 26 and 27 respectively of the viewing opening and have upper portions 68 and 69 spaced above the upper portions 52 and 54 of the front and rear walls of the cowl. In addition, intermediate portions of the side walls immediately above the lower portions 63 and 64 taper rapidly to a relatively thin portion which extends upwardly to the upper edges of the upper portions. This results in the side walls being considerably thinner than the forward and rear walls and thus are more flexible than the forward and rear walls to facilitate lateral movement of the side walls to accommodate faces of different sizes. It has been found that, with a suitable selection of cowl material flexibility and thickness, if the upper portions of the side walls are spaced apart at a spacing 71 of between approximately 4.25 and 5.5 inches (11 and 14 cms), thin faces of relatively young children to fuller faces of adults can be accommodated by flexibility in the side walls. It is added that the side walls of the cowl do not have to grip the face or temples to provide a waterproof seal therewith but instead merely restrict passage of water into the opening. The side walls extend sufficiently rearwardly of the head (i.e. upwardly of the hull) beyond the person's eyes to be held relatively closely adjacent the person's temples so as to essentially eliminate intrusion of light onto the viewing unit, thus improving viewing conditions. In addition, the person can wear eye glasses 72 as shown, which interfere negligibly with the walls of the cowl.

FIGS. 3 through 6

Figure 6:
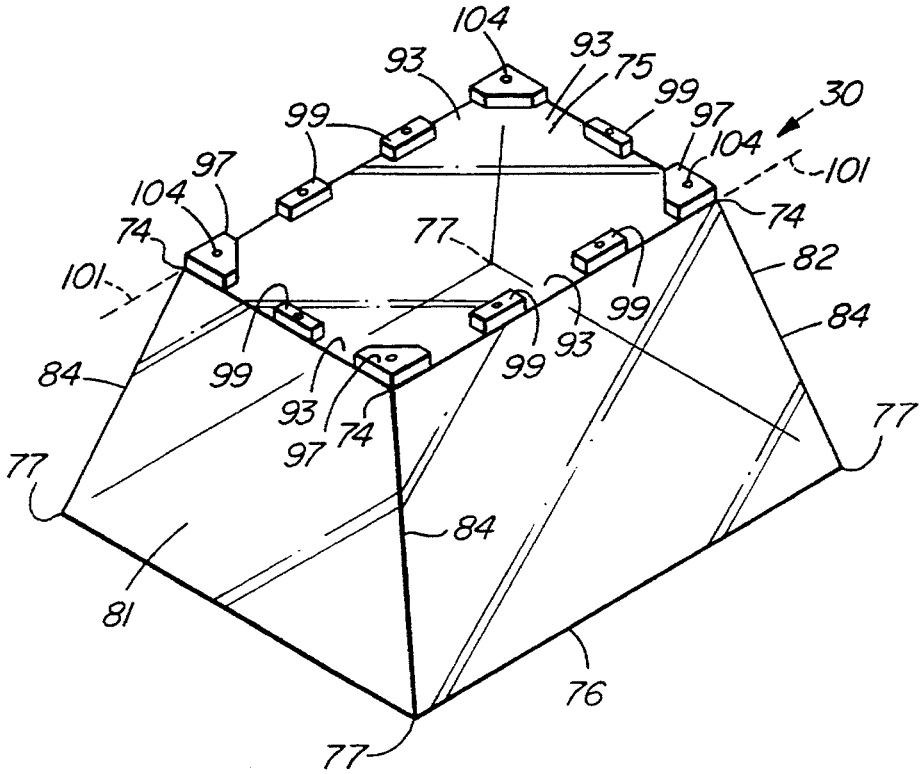
FIG. 6 is a simplified perspective of the viewing unit by itself after removal from the watercraft.
Figure 7:
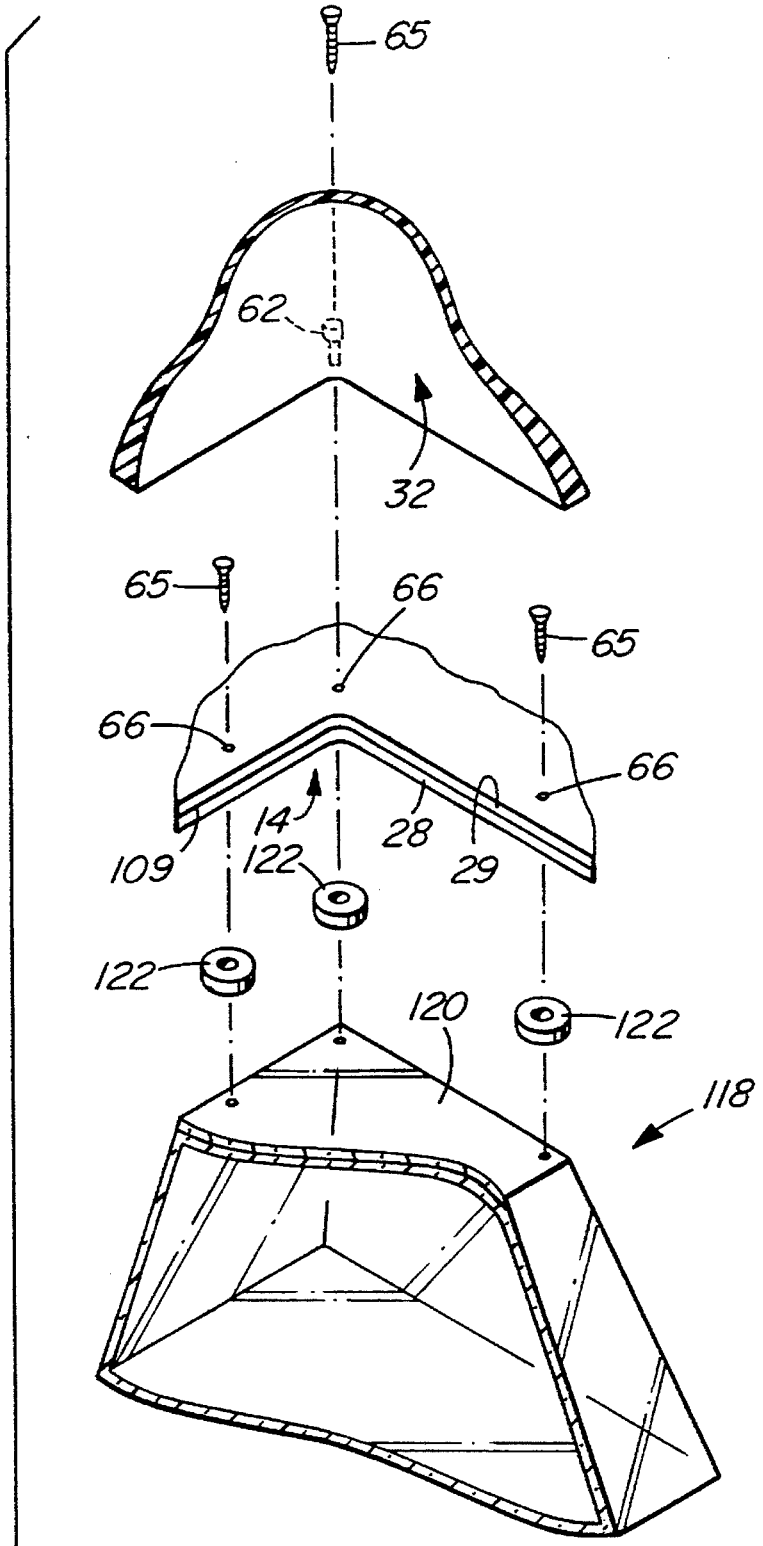
FIG. 7 is a simplified fragmented perspective showing some components associated with the viewing unit.

Referring to FIGS. 3, 4 and 6 the viewing unit 30 has vertically spaced apart upper and lower rectangular transparent panels 75 and 76 which are parallel to each other and generally parallel to an upper portion of the hull so as to be generally horizontal when the watercraft floats evenly loaded on calm water. The upper and lower panels 75 and 76 have relatively sharp corners 74 and 77 respectively, i.e. corners having relatively small radii. The lower panel 76 is larger than the upper panel and is spaced symmetrically relative thereto when viewed longitudinally in FIG. 3, and transversely in FIG. 4. The viewing unit has forward and rear panels 78 and 79, and side panels 81 and 82 which extend between respective adjacent edges of the upper and lower panels. For convenience, hereinafter and in the claims, the panels 78, 79, 81 and 82 can be referred to as wall panels and thus it can be seen that the viewing unit has four wall panels, each of which has parallel upper and lower edges located adjacent corresponding edges of the upper and lower panels to form a truncated, four-sided pyramidal shape having four outwardly and downwardly diverging wall panels. It can be sen that each wall panel is a trapezium, that is a quadrilateral having two opposite sides parallel to each other. The panels 78 and 79 are similar to each other, and the panels 81 and 82 are also similar to each other. The wall panels have side edges which intersect each other at relatively sharp elongated corners 84, i.e. they have small radii similarly to the sharp corners 74 and 77 of the panels 75 and 76 respectively. The viewing unit is hollow and is manufactured to provide a hermetically sealed unit, preferably containing relatively dry sterile air therein to reduce problems relating to condensation and to be purged of any living matter that might contribute to formation of molds, etc. In one embodiment, perpendicular spacing between the upper and lower panels 75 and 76, defining depth of the unit, is about 6 inches (15 cms), but could be within a range of between 5 and 12 inches (13 and 30 cms). Angles of the wall panels to the vertical can be between about 15 degrees and 30 degrees. In this particular embodiment, the upper panel is 5.5×8.5 inches (14×21.5 cms), and the lower panel is 9.25×11.25 inches (23.5×28.5 cms).

The viewing unit can be made by bonding cut panels of "Plexiglass" (trade-mark) or transparent polycarbonate or equivalents, using a suitable adhesive, or by injection molding five panels as an integral unit, which can then be sealed by a final sixth panel in a suitable atmosphere.

As best seen in FIG. 4, the opening forward and rear walls 22 and 24 are inclined forwardly and rearwardly respectively at angles generally similar to angles of inclination of the forward and rear wall panels 78 and 79 of the viewing unit. Similarly, as seen in FIG. 3, the opening side walls 26 and 27 are similarly inclined downwardly and outwardly at angles generally similar to angles of inclination of the side or wall panels 81 and 82 of the viewing unit. Thus, forward and rear clearances 85 and 86 extend between the oppositely facing pairs of walls 22 and 78, and 24 and 79 respectively, and side clearances 88 and 89 extend between the oppositely facing pairs of walls 26 and 81, and 27 and 82 respectively. Thus, at a particular horizontally disposed station or location within the viewing opening, the rectangular-sectioned viewing opening is larger than the rectangular-sectioned viewing unit to provide a clearance therearound, and also to facilitate insertion of the unit into the opening for installation and removal. Thus, the four opening walls of the hull are spaced from adjacent wall panels of the viewing unit by generally parallel sided clearance spaces, which provide draining spaces to permit drainage between the upper and lower hull portions as will be described.

Figure 5:
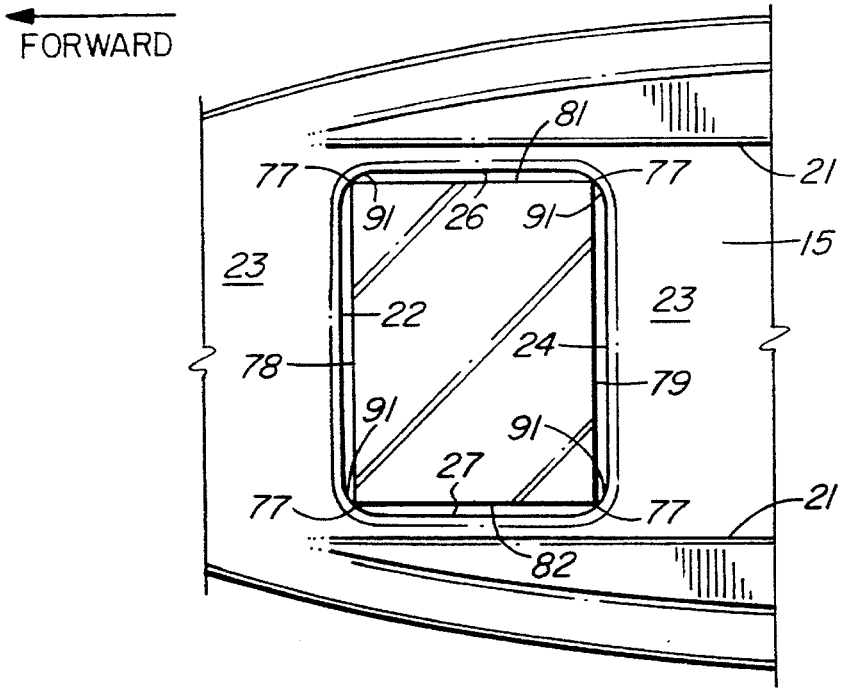
FIG. 5 is a simplified fragmented bottom plan showing a lower panel of the viewing unit and surrounding portions of the watercraft.

As best seen in FIG. 5, adjacent opening walls intersect each other at opening wall corners 91 which have relatively large radii when compared with the relatively small radii of adjacent panel corners 74 and 77, and elongated corners 84 of the viewing unit. The large radii of the opening wall corners 91 adjacent the central surface 23 of the hull portion 15 are sufficiently large to contact at least the corners 77 of the lower panel of the viewing unit to restrict relative movement between the viewing unit and the hull as will be described. Thus, the opening wall corners 91 contact the small radius of at least some lower panel corners 77 in a relatively tight fit so as to restrict lateral movement as will be described. It is not necessary that radii between adjacent walls of the viewing opening are of a constant radius, or that the opening wall corners 91 contact the elongated corners 84 of the viewing for the whole length of the elongated corners between adjacent side panels. To accommodate manufacturing tolerances, provided at least two opposite corners of the wall corners of the viewing unit, or of the lower panel of the viewing unit are close or contact adjacent radii of the opening side wall, lateral movement of the unit will be restricted sufficiently to reduce loads on the viewing unit. Because the viewing unit is secured to the watercraft only at the upper portions of the unit, it is best to restrict movement of the lower portions of the viewing unit, thus reducing forces on the fasteners securing the viewing unit to the watercraft hull. Restriction of movement is best accomplished by the interference between portions of the hull and the lower portions of the viewing unit, and clearly other means of preventing such movement can be devised. In addition, the lower panel 76 of the viewing unit is recessed with respect to the central surface 23 of the hull so as not to project downwardly beneath the central surface, so as to reduce chances of damage to the viewing unit, e.g. by contact with foreign objects. Thus, if the watercraft is being pulled along the ground by the handle 11 on the hull, or is floating in shallow water, the chances of sand or other projections scratching the lower panel 76 of the unit are essentially negligible, thus maintaining a clear, unscratched viewing unit.

As best seen in FIG. 6, a margin portion 93 of the upper panel 75 of the viewing unit has a plurality of projections extending upwardly therefrom. The projections comprise two types, namely generally triangular projections 97 fitted adjacent the corners 74 of the upper panel, and rectangular projections 99 fitted adjacent sides of the upper panel. The projections 97 and 99 have upper surfaces which are coplanar with each other and disposed within an undesignated projection plane. It can be seen that the margin portion 93 of the upper surface of the viewing unit is thus castellated or crenellated with a plurality of upwardly extending integral projections of equal heights. For manufacturing simplicity, the projections 97 and 99 are provided with threaded fastener openings 104 to receive ends of the fasteners 65 when installed as shown in FIG. 3. The viewing unit thus has a plurality of fastener openings adjacent the periphery thereof which can be aligned with the plurality of fastener openings 66 in the rim of the hull (see FIG. 3).

As best seen in FIGS. 3 and 4, the upper panel 75 has an upper surface, defined as a first plane 101 (shown as a broken line) which is thus spaced below the undesignated plane containing coplanar upper surfaces of the projections. The lower rim 28 of the viewing opening 20 has a lower surface 109 defining a lower surface of the opening rim within the hull, and is disposed within a second plane 110 (shown as a broken line). The plurality of projections 97 and 99 thus extend between the upper surface of the viewing unit in the plane 101 and the lower surface of the rim in the plane 110 to serve as spacers to space the upper and lower surfaces apart to provide a plurality of clearance openings 106 between the planes 101 and 110 extend around the unit. In this way, any water or other fine foreign matter lying on the upper panel of the viewing unit tends to drain outwardly and horizontally through the clearance openings 106 as shown by undesignated arrows. The water, etc. then passes downwardly and slightly outwardly through the clearance openings between the side walls of the viewing opening and the wall panels of the viewing unit. The clearance openings 106 between the planes 101 and 110 are slightly smaller than the clearances 85, 86, 88 and 89 serving as the draining spaces between the viewing unit and side walls of the viewing opening, so that any relatively coarse material, that is material that is larger then the openings 106, cannot pass through the clearance openings, and instead is trapped at the openings 106 and is usually removed manually therefrom. This prevents relatively coarse material from becoming trapped between walls of the viewing unit and the opening side walls, which could otherwise cause damage due to relative movement between the walls.

In summary, it can be seen that most of the periphery of the viewing unit is spaced from the viewing opening side walls to define the clearance spaces which provide a peripheral clearance extending generally around the unit. Any water and fine material initially drains generally horizontally through the clearance openings 106 extending around the unit, and then generally vertically and slightly outwardly through the clearances between the viewing unit and the opening side wall.

OPERATION

The watercraft is sufficiently light to enable a reasonably strong individual to carry it a short distance to the water, whereupon it can be easily placed on the water and the person can then lie prone upon the upper portion of the watercraft. The person's face is located comfortable with the nose received in the clearance portion 56, and the forehead supported on the upper portion 52 thus relieving the neck of weight of the head. The upper portions 68 and 69 of the side walls embrace the temples and restrict entry of light that would otherwise tend to shine on the upper surface of the viewing unit. When the watercraft is fully immersed with a person lying on it, the water line is approximately as shown at 114 in FIG. 3 and is thus spaced well above the lower panel 76 of the viewing unit. Thus, in a light "choppy" sea, air is usually restricted from the lower panel 76 of the viewing unit. If any air does pass under the lower panel 76, the air does not become trapped because it can pass upwardly through the clearance spaces, and thus viewing is relatively undisturbed.

In some conditions, for example when the watercraft encounters the wake of a passing hull, waves can break over the deck, and if the person's face is removed from the mask, or does not completely seal the mask, water and other debris can pass into the cowl. Also, if the watercraft is exposed to breaking waves in shallow water, water and beach debris, for example sand, shells, etc. can enter the cowl and then fine material can pass between the openings 106 and out through the clearances 85, 86, 88 and 89. Any relatively coarse material which does not pass through the clearance openings 106 will become trapped and is removed manually from the upper surface. Clearly, any water or relatively fine debris within the cowl passes through the clearances passages between the upper and lower portions of the hull, and does not pass across the upper surface of the hull as in some prior art structure, and thus does not inconvenience the person lying on the watercraft.

ALTERNATIVES

Preferably, the viewing unit has upper and lower surfaces which are spaced apart to provide a relatively large separation between the upper and lower surfaces of the viewing unit to enhance viewing conditions. In most circumstances, viewing conditions are best if the lower surface is always immersed fully in the water, and the upper surface is relatively close to the eyes. In this way, there is little chance of wave action and rocking or pitching of the watercraft permitting air to pass between the lower surface of the viewing unit and the water. Also, as the eyes are close to the upper surface, chances of extraneous light or other reflections interfering with viewing are minimal. However, in some applications for example for very young children, on a small craft, a relatively thin or solid viewing unit having a thickness of about 3 to 5 inches (7 to 13 cms) could be substituted for the hollow viewing unit, in which case the watercraft would have a shorter depth resulting in a lower volume to ensure that the lower surface of the viewing unit remained submerged. Nevertheless, to avoid problems with water and other matter collecting on the upper surface of the viewing unit, the viewing unit would have the clearance openings 106 between the rim portion of the viewing opening and the viewing unit to permit water and any fine foreign matter thereon to drain through the clearance opening. In this alternative, as in the preferred embodiment, the viewing unit is fitted within the viewing opening as before, and most of the periphery of the viewing unit is spaced from the opening side wall to define a draining space between the opening side wall and the viewing unit to provide a peripheral clearance extending around the unit for draining water from the hull irrespective of angle of the watercraft with respect to the horizontal.

The preferred embodiment as illustrated discloses a hollow generally rectangular-sectioned, truncated pyramidal viewing unit. Viewing units of other shapes can be devised. However, if alternative shaped viewing units are devised, preferably the viewing opening in the hull has a shape generally complementary to side walls of the viewing unit. In this way, portions of the periphery of the viewing unit can contact spaced apart portions of the opening side wall to restrict relative movement therebetween as shown. For example, the periphery of the viewing unit can be polygonal when viewed from above having a plurality of corners, for example it could be hexagonal with six corners. The opening side wall would be a closed shape which encloses the polygonal periphery of the viewing unit and at least two corners of the viewing unit, preferably on opposite sides thereof, contact the opening side wall to restrict movement therebetween. In another alternative, the viewing unit could be cylindrical, with circular shaped upper and lower panels, and a cylindrical side wall. In this instance, as no corners are available to contact corners of the viewing opening, projections could extend, preferably from the viewing opening side wall, to contact the periphery of the viewing unit so as to restrict excessive movement therebetween.

In the particular construction shown, the viewing opening 20 in the hull is defined by coincident edges of the rims 28 and 29 of the hull portions 15 and 14 respectively. This is clearly for manufacturing convenience and while two rims are an advantage to provide increased stiffness to enhance rigidity of the connection to the viewing unit, in some structures an alternative rim structure can be substituted with suitable stiffeners being obtained by other structure.

In the first embodiment, the projections 97 and 99 serve as integral spacers for the viewing unit and have the fastener openings 104 that can be aligned with the fastener openings in the rim to receive the fasteners, some of which also pass through the aligned openings in the cowl to simultaneously secure the cowl and the viewing unit to the hull. Clearly, separate fasteners can be used to secure the cowl and the viewing unit.

FIG. 7

An alternative viewing unit 118 is a truncated triangular-sectioned pyramidal shape generally similar to the unit 30 shown in FIG. 6, but differs by having an upper panel 120 which is flat and does not have integral spacers or projections thereon as shown in the unit 30. The alternative unit 118 has instead an alternative spacer comprising a plurality of relatively thick washers 122 having fastener clearance openings therein to receive fasteners, three fasteners 65 being shown. The upper panel 120 of the unit has threaded openings to cooperate with the fasteners so that, when the viewing unit is assembled, the fasteners pass through the openings 66 in the rims 28 and 29, through the washers into the threaded openings of the viewing unit. Clearly, as before, the lower surface 109 of the opening rim is disposed in the second plane (not shown), and an upper surface of the panel 120 is in a first plane, not shown, the planes being separated by thickness of the washers 122.

The alternative viewing unit 118 thus has non-integral spacers and is preferred in some circumstances. Clearly, depth of threaded openings in the upper panel 120 must be sufficient to cooperate with the screws 65. This can contrast with the unit 30 where the depth of thread can extend through both the spacer and into the upper panel of the viewing unit if required. Clearly, to maintain the hermetic seal of the viewing unit, the threaded openings in either of the units must not penetrate into the interior of the viewing unit.

What is claimed is:

1. A watercraft comprising:

(a) a hull having generally spaced apart upper and lower hull portions, a peripheral edge portion extending peripherally around and between the upper and lower hull portions, and a viewing opening defined by an opening sidewall extending through the hull between the upper and lower hull portions, and (b) a viewing unit fitted within the viewing opening and having a periphery, most of the periphery being spaced from the opening sidewall to define a draining space between the opening sidewall and the viewing unit to provide a peripheral clearance extending generally around the unit for draining water through the hull irrespective of angle of the watercraft with respect to the horizontal.

2. A watercraft as claimed in claim 1, further comprising:

(a) a cowl extending peripherally around the viewing opening, the cowl having a lower portion cooperating with the periphery of the opening, and an upper portion to embrace portions of a person's face so as to restrict passage of water into the viewing opening and to essentially exclude extraneous light from shining onto an upper surface of the viewing unit.

3. A watercraft as claimed in claim 2, in which:

(a) the cowl comprises a forward wall and a rear wall, the walls extending upwardly from adjacent forward and rear edges respectfully of the viewing opening, (b) the rear wall having an upper portion with a nose clearance portion to embrace a bridge portion of a nose of the person remote from the nostrils thereof to prevent discharge of air from the nose or mouth onto the viewing unit, and (c) the forward wall having an upper portion to contact a forehead of the person and is spaced generally above the upper edge of the rear wall.

4. A watercraft as claimed in claim 3, in which the cowl further comprises:

(a) a pair of side walls extending upwardly from opposite side edges of the viewing opening, the side walls having upper portions spaced above the upper portions of the front and rear walls of the cowl.

5. A watercraft as claimed in claim 4, in which:

(a) the side walls are more flexible than the forward and rear walls to facilitate lateral movement of the side walls to accommodate faces of different sizes.

6. A watercraft as claimed in claim 1, in which:

(a) the viewing unit has vertically spaced apart upper and lower transparent panels, and at least one wall panel extending between the upper and lower transparent panels to define a closed interior between the panels.

7. A watercraft as claimed in claim 6, in which:

(a) the opening side wall of the hull is spaced from the wall panel of the viewing unit by the draining space to permit drainage between the upper and lower hull portions.

8. A watercraft as claimed in claim 6, in which:

(a) the viewing unit has an upper surface in a first plane, (b) the viewing opening in the hull is defined by a rim, the rim having a lower surface in a second plane, (c) at least one spacer extends between the upper surface of the viewing unit and the lower surface of the rim to space the upper and lower surfaces apart to provide a plurality of clearance openings between the planes and extending around the unit, and (d) the clearance openings between the planes are smaller than the draining space between the side panel of the viewing unit and the opening side wall of the opening, so that relatively coarse material is restricted from passing the clearance opening and thus does not become trapped between the hull side wall and the side panel of the viewing unit.

9. A watercraft as claimed in claim 6, in which:

(a) the upper and lower panels of the viewing unit are parallel to each other and generally parallel to the upper portion of the hull, and (b) the lower panel is larger than the upper panel so that at least a portion of the said at least one side panel extends downwardly and outwardly between the upper and lower panels.

10. A watercraft as claimed in claim 9, in which:

(a) the lower panel of the viewing unit is polygonal in section when viewed from above and has a plurality of corners, and (b) the opening side wall is a closed shape which encloses the polygonal side panel of the viewing unit, and at least two corners of the viewing unit contact the opening side wall.

11. A watercraft as claimed in claim 10, in which:

(a) the upper and lower panels of the viewing unit are rectangular, each panel having four corners having relatively small radii, (b) the viewing unit has four wall panels, each of which has parallel upper and lower edges located adjacent corresponding edges of the upper and lower panels to form a truncated pyramidal four sided shape having four outwardly and downwardly diverging side wall corners having relatively small radii, and (c) the opening side wall is rectangular when viewed vertically and is larger than the rectangular viewing unit, the opening side wall having four corners with relatively large radii which are sufficiently large to contact at least two of the relatively small radii of the lower panel or side wall corners of the viewing unit to restrict relative movement between the viewing unit and the hull.

12. A watercraft as claimed in claim 6, in which:

(a) portions of the periphery of the viewing unit contact portions of the opening side wall to restrict relative movement therebetween.

13. A watercraft as claimed in claim 1, in which:

(a) portions of the periphery of the viewing unit contact spaced apart portions of the opening side wall to restrict relative movement therebetween.

14. A watercraft as claimed in claim 13, in which:

(a) the periphery of the viewing unit is polygonal when viewed from above having a plurality of corners, and (b) the opening side wall is a closed shape which encloses the polygonal periphery of the viewing unit, and at least two corners of the viewing unit contact the opening side wall.

15. A watercraft as claimed in claim 14, in which:

(a) the periphery of the viewing unit is rectangular with four corners having relatively small radii, and (b) the opening side wall is rectangular when viewed from above and is larger than the rectangular viewing unit, the side wall having four corners with relatively large radii which are sufficiently large to contact the relatively small radii of the corners of the viewing unit to restrict relative movement between the viewing unit and the hull.

16. A watercraft as claimed in claim 1, in which:

(a) the viewing unit has an upper surface in a first plane, (b) the viewing opening in the hull is defined by an opening rim having a lower surface in a second plane, and (c) a spacer extends between the upper surface of the viewing unit and the lower surface of the rim to space the upper and lower surfaces apart to provide a plurality of clearance openings between the planes and extending around the unit.

17. A watercraft as claimed in claim 16, in which:

(a) the rim of the viewing opening in the hull has a plurality of fastener openings passing therethrough, the plurality of fastener openings extending peripherally around the viewing opening, (b) the viewing unit has a plurality of fastener openings adjacent the periphery thereof which can be aligned with the plurality of fastener openings in the rim of the hull, (c) the spacer has a plurality of fastener openings that can be aligned with the fastener openings in the rim and the viewing unit, and (d) a plurality of fasteners pass through the aligned fastener openings in the rim, the spacer and the viewing unit to secure the viewing unit to the hull.

18. A watercraft as claimed in claim 17, in which:

(a) the spacer is integral with the viewing unit.

19. A watercraft as claimed in claim 16, in which:

(a) the upper surface of the viewing unit is castellated and has a plurality of upwardly extending integral projections with threaded fastener openings therein to provide the spacer essentially integral with the viewing unit.

20. A watercraft as claimed in claim 16, in which:

(a) the spacers are relatively thick washers having fastener openings therein to receive the fasteners, and (b) the fastener openings in the viewing unit are threaded to cooperate with the fasteners.

21. A watercraft as claimed in claim 1, in which the lower hull portion comprises:

(a) a pair of laterally spaced apart longitudinally extending sponsons extending downwardly from outer portions of the hull, and (b) a central surface of the hull extending between the sponsons, the central surface having the viewing opening therein to receive the viewing unit, the viewing unit having a lower transparent panel which is recessed with respect to the central surface of the hull so as not to project downwardly beneath the central surface to reduce chances of damage to the viewing unit.

* * * * *